US012377339B1

(12) United States Patent
Rivera, Jr.

(10) Patent No.: US 12,377,339 B1
(45) Date of Patent: Aug. 5, 2025

(54) SHIN GUARD WITH A SPRING BIASED KNEE JOINT

(71) Applicant: Ismael Rivera, Jr., East Meadow, NY (US)

(72) Inventor: Ismael Rivera, Jr., East Meadow, NY (US)

( * ) Notice: Subject to any disclaimer, the term of this patent is extended or adjusted under 35 U.S.C. 154(b) by 0 days.

(21) Appl. No.: 18/609,106

(22) Filed: Mar. 19, 2024

(51) Int. Cl.
*A63B 71/12* (2006.01)

(52) U.S. Cl.
CPC .. *A63B 71/1225* (2013.01); *A63B 2071/1258* (2013.01)

(58) Field of Classification Search
CPC ..... A63B 2071/1258; A63B 71/1225; A63B 2071/125; A63B 2071/1241; A63B 2071/1275; A61F 5/0123; A61F 5/0125; A61F 5/0102; A61F 2005/0172; A61F 2005/0176; A61F 5/0585; A61F 2005/0132; A41D 13/0543; A41D 13/0568; A41D 13/06; A41D 13/065
USPC ..... 2/22, 24; 601/5; 602/16, 12, 23, 26
See application file for complete search history.

(56) References Cited

U.S. PATENT DOCUMENTS 572,642 A * 12/1896 Laird ..... A41D 13/065 2/24
1,155,491 A * 10/1915 Holsey ..... A41D 13/065 2/24
1,571,088 A * 1/1926 Buchanan ..... A41D 13/0568 2/24
3,928,872 A * 12/1975 Johnson ..... A61F 5/0106 2/22
4,370,977 A * 2/1983 Mauldin ..... A61F 5/0123 602/26
4,450,832 A * 5/1984 Waddell ..... A61F 5/0104 2/22
D297,178 S 8/1988 Jurga
5,052,379 A * 10/1991 Airy ..... A61F 5/0125 482/901
5,707,347 A 1/1998 Bixler
7,553,289 B2 6/2009 Cadichon
9,149,709 B1 10/2015 Schuster
10,293,241 B2 5/2019 Rodrick
11,202,954 B2 12/2021 Runzo
(Continued)

FOREIGN PATENT DOCUMENTS

CN 110613189 A * 12/2019
KR 101575998 B1 * 12/2015
(Continued)

*Primary Examiner* — Amy Vanatta
(74) *Attorney, Agent, or Firm* — Kyle A. Fletcher, Esq.

(57) ABSTRACT

The shin guard with a spring biased knee joint is adapted for use with the leg of an individual. The shin guard with a spring biased knee joint protects the leg of the individual from injury. The shin guard with a spring biased knee joint is a mobility assistance device. The shin guard with a spring biased knee joint assists the individual when the individual moves from a crouching position to a standing position. The shin guard with a spring biased knee joint incorporates a shin guard structure, a thigh guard structure, a knee guard structure, and a torsion spring structure. The shin guard structure attaches to the knee guard structure. The thigh guard structure attaches to the knee guard structure. The torsion spring structure assists in the movement from a crouching position to a standing position.

11 Claims, 4 Drawing Sheets

(56) References Cited

U.S. PATENT DOCUMENTS

| | | | | |
|---|---|---|---|---|
| 2002/0052568 | A1* | 5/2002 | Houser | B60R 22/001 602/26 |
| 2007/0078363 | A1* | 4/2007 | Kuehnle | A61F 5/0102 602/5 |
| 2007/0250977 | A1* | 11/2007 | Brown | A41D 13/0543 2/22 |
| 2017/0055603 | A1* | 3/2017 | Guidetti | A41D 13/0543 |
| 2019/0192954 | A1* | 6/2019 | Runzo | A63B 71/1225 |
| 2021/0379475 | A1 | 12/2021 | Dierkes | |
| 2023/0310250 | A1* | 10/2023 | Carr | B25J 9/0006 601/5 |

FOREIGN PATENT DOCUMENTS

| | | | |
|---|---|---|---|
| KR | 101599670 | B1 * | 3/2016 |
| KR | 101690422 | B1 * | 12/2016 |

* cited by examiner

SHIN GUARD WITH A SPRING BIASED KNEE JOINT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of body-protectors. (A63B71/1225)

SUMMARY OF INVENTION

The shin guard with a spring biased knee joint is adapted for use with the leg of an individual. The shin guard with a spring biased knee joint is a guard. The shin guard with a spring biased knee joint protects the leg of the individual from injury. The shin guard with a spring biased knee joint is a mobility assistance device. The shin guard with a spring biased knee joint assists the individual when the individual moves from a crouching position to a standing position. The shin guard with a spring biased knee joint comprises a shin guard structure, a thigh guard structure, a knee guard structure, and a torsion spring structure. The shin guard structure attaches to the knee guard structure. The thigh guard structure attaches to the knee guard structure. The torsion spring structure assists the individual when moving from a crouching position to a standing position.

These together with additional objects, features and advantages of the shin guard with a spring biased knee joint will be readily apparent to those of ordinary skill in the art upon reading the following detailed description of the presently preferred, but nonetheless illustrative, embodiments when taken in conjunction with the accompanying drawings.

In this respect, before explaining the current embodiments of the shin guard with a spring biased knee joint in detail, it is to be understood that the shin guard with a spring biased knee joint is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the shin guard with a spring biased knee joint.

It is therefore important that the claims be regarded as including such equivalent construction insofar as they do not depart from the spirit and scope of the shin guard with a spring biased knee joint. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
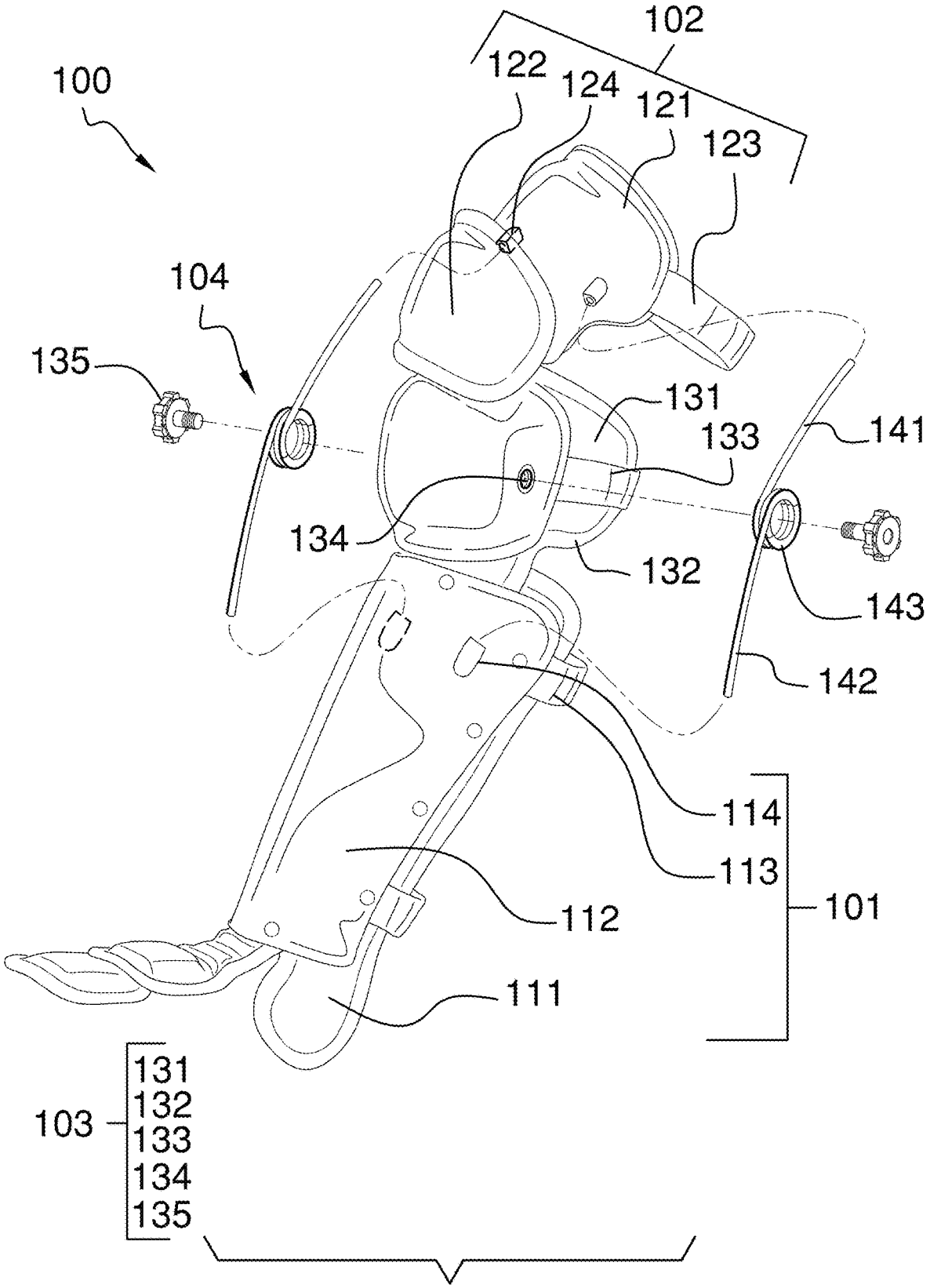
FIG. 1 is a perspective view of an embodiment of the disclosure.
Figure 2:
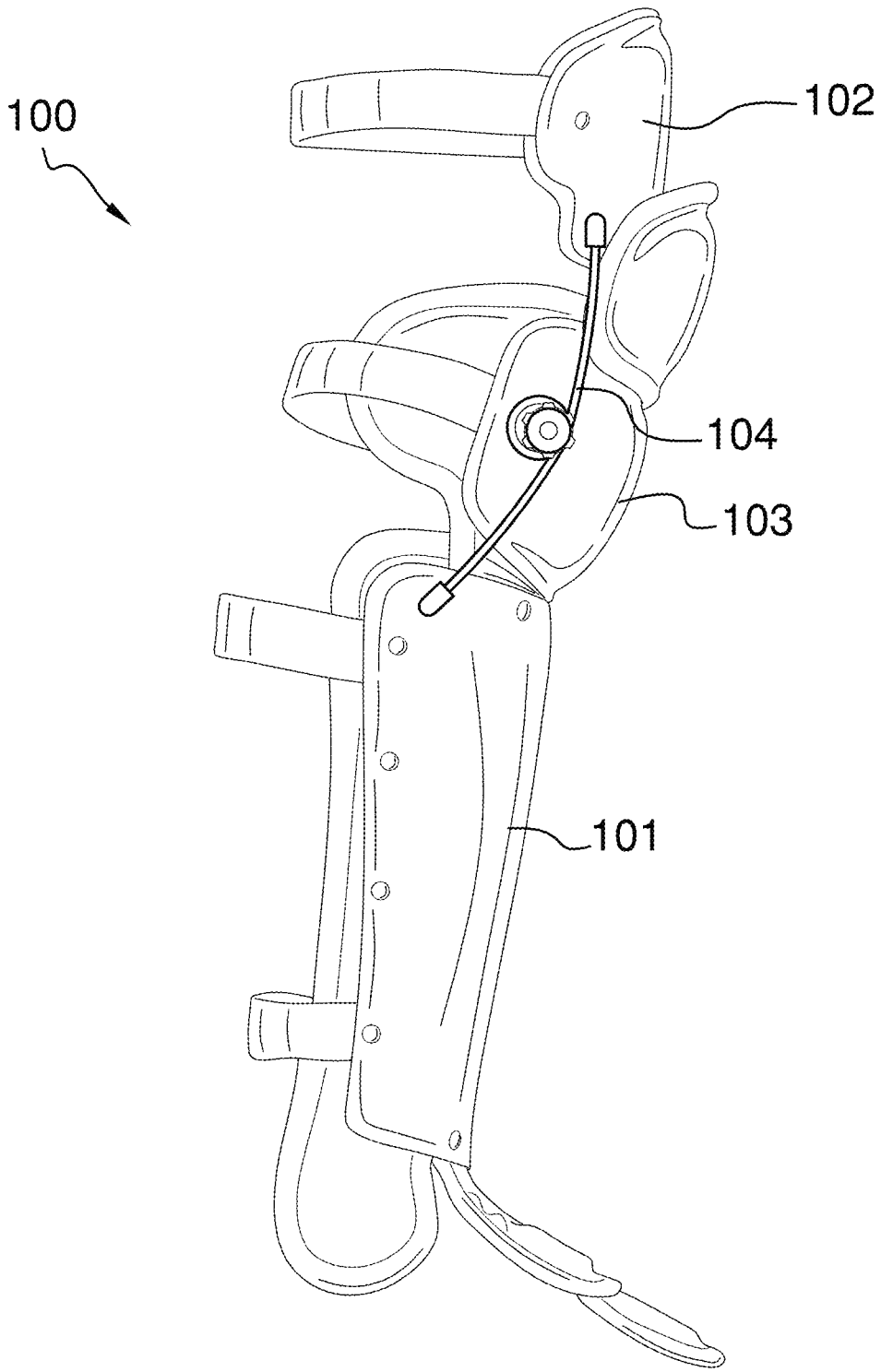
FIG. 2 is a relaxed side view of an embodiment of the disclosure.
Figure 3:
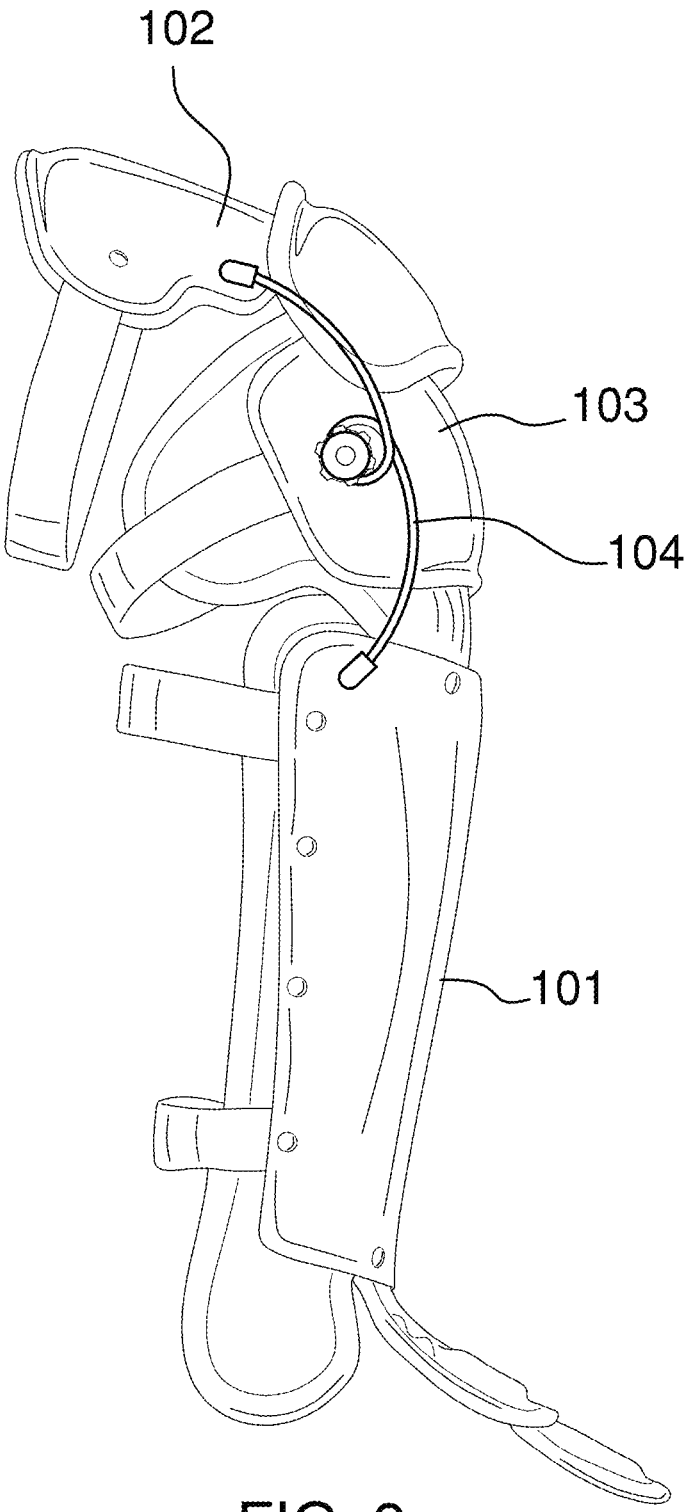
FIG. 3 is a deformed side view of an embodiment of the disclosure.
Figure 4:
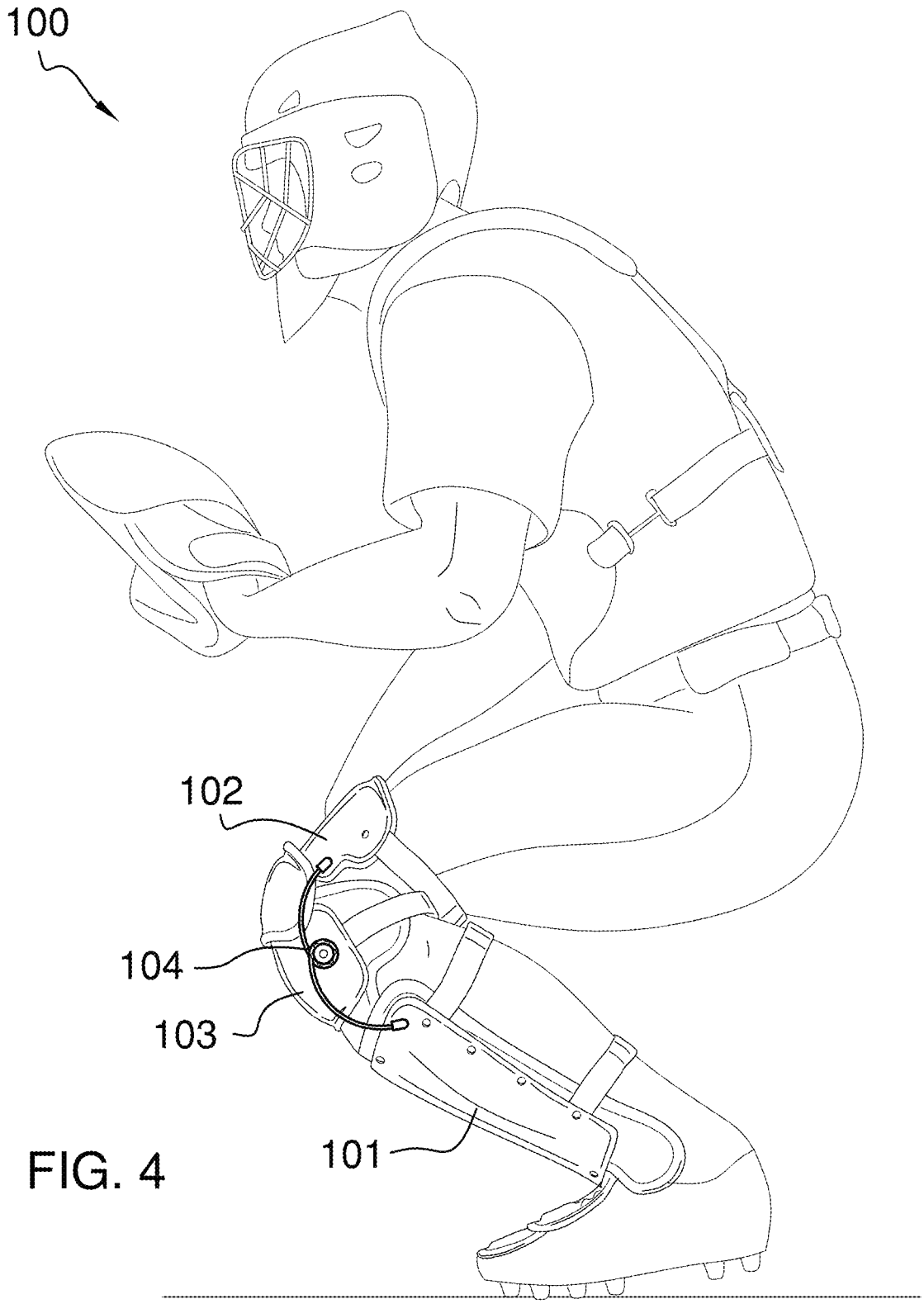
FIG. 4 is an in-use view of an embodiment of the disclosure.

Detailed reference will now be made to one or more potential embodiments of the disclosure, which are illustrated in FIGS. 1 through 4.

The shin guard with a spring biased knee joint 100 (hereinafter invention) is adapted for use with the leg of an individual. The invention 100 is a guard. The invention 100 protects the leg of the individual from injury. The invention 100 is a mobility assistance device. The invention 100 assists the individual when the individual moves from a crouching position to a standing position. The invention 100 comprises a shin guard structure 101, a thigh guard structure 102, a knee guard structure 103, and a torsion spring structure 104. The shin guard structure 101 attaches to the knee guard structure 103. The thigh guard structure 102 attaches to the knee guard structure 103. The torsion spring structure 104 assists the individual when moving from a crouching position to a standing position.

In this disclosure, the knee refers to a joint that joins the superior bones of the leg of an individual to the inferior bones of the leg of the individual. The shin refers to the portion of a leg that is inferior to the knee. The thigh refers to the portion of a leg that is superior to the knee.

The shin guard structure 101 is a protective structure. The shin guard structure 101 is a worn structure. The shin guard structure 101 encloses the shin of a leg. The shin guard structure 101 forms a barrier structure that protects the shin of the leg from impact injury. The shin guard structure 101 has a non-Euclidean disk structure. The shin guard structure 101 has a composite prism structure. The shin guard structure 101 comprises a shin pad 111, a shin plate 112, a plurality of shin straps 113, and a shin spring mount 114.

The shin pad 111 is a disk shaped structure. The shin pad 111 has a non-Euclidean disk shape. The shin pad 111 is an elastic structure. The shin pad 111 is the structure of the shin guard structure 101 that is proximal to the shin of the leg. The shin pad 111 is geometrically similar to the shin of the leg. The shin pad 111 encloses the shin of the leg. The shin pad 111 is a cushion that forms a protective barrier between the shin plate 112 and the shin of the leg. The shin pad 111 absorbs impact energy received from the shin plate 112. The absorbed impact energy deforms the elastic structure of the shin pad 111.

The shin plate 112 is a disk shaped structure. The shin plate 112 has a non-Euclidean disk shape. The shin plate 112 is a rigid structure. The shin plate 112 is the structure of the shin guard structure 101 that is distal from the shin of the leg. The shin plate 112 is geometrically similar to the shin pad 111. The shin plate 112 encloses the shin pad 111. The shin plate 112 forms the exterior surface of the protective barrier formed by the shin guard structure 101 that receives impact energy from the environment. The shin plate 112 deflects a portion of the received impact energy away from the shin pad 111. The shin plate 112 transfers the balance portion of the received impact energy to the shin pad 111. The shin pad 111 mounts in the interior surface of the shin plate 112 to form the composite disk structure of the shin guard structure 101.

The plurality of shin straps 113 is a textile based structure. The plurality of shin straps 113 is formed from a collection of textile based straps. The plurality of shin straps 113 are used to bind the shin guard structure 101 to the shin of the leg.

The shin spring mount 114 is an anchor point. The shin spring mount 114 mounts to the exterior surface of the shin plate 112. The shin spring mount 114 forms an anchor point. The torsion spring structure 104 attaches to the shin guard structure 101 by anchoring to the shin spring mount 114.

The thigh guard structure 102 is a protective structure. The thigh guard structure 102 is a worn structure. The thigh guard structure 102 encloses the thigh of a leg. The thigh guard structure 102 forms a barrier structure that protects the thigh of the leg from impact injury. The thigh guard structure 102 has a non-Euclidean disk structure. The thigh guard structure 102 has a composite prism structure. The thigh guard structure 102 comprises a thigh pad 121, a thigh plate 122, a plurality of thigh straps 123, and a thigh spring mount 124.

The thigh pad 121 is a disk shaped structure. The thigh pad 121 has a non-Euclidean disk shape. The thigh pad 121 is an elastic structure. The thigh pad 121 is the structure of the thigh guard structure 102 that is proximal to the thigh of the leg. The thigh pad 121 is geometrically similar to the thigh of the leg. The thigh pad 121 encloses the thigh of the leg. The thigh pad 121 is a cushion that forms a protective barrier between the thigh plate 122 and the thigh of the leg. The thigh pad 121 absorbs impact energy received from the thigh plate 122. The absorbed impact energy deforms the elastic structure of the thigh pad 121.

The thigh plate 122 is a disk shaped structure. The thigh plate 122 has a non-Euclidean disk shape. The thigh plate 122 is a rigid structure. The thigh plate 122 is the structure of the thigh guard structure 102 that is distal from the thigh of the leg. The thigh plate 122 is geometrically similar to the thigh pad 121. The thigh plate 122 encloses the thigh pad 121. The thigh plate 122 forms the exterior surface of the protective barrier formed by the thigh guard structure 102 that receives impact energy from the environment. The thigh plate 122 deflects a portion of the received impact energy away from the thigh pad 121. The thigh plate 122 transfers the balance portion of the received impact energy to the thigh pad 121. The thigh pad 121 mounts in the interior surface of the thigh plate 122 to form the composite disk structure of the thigh guard structure 102.

The plurality of thigh straps 123 is a textile based structure. The plurality of thigh straps 123 is formed from a collection of textile based straps. The plurality of thigh straps 123 are used to bind the thigh guard structure 102 to the thigh of the leg.

The thigh spring mount 124 is an anchor point. The thigh spring mount 124 mounts to the exterior surface of the thigh plate 122. The thigh spring mount 124 forms an anchor point. The torsion spring structure 104 attaches to the thigh guard structure 102 by anchoring to the thigh spring mount 124.

The knee guard structure 103 is a protective structure. The knee guard structure 103 is a worn structure. The knee guard structure 103 encloses the knee of a leg. The knee guard structure 103 forms a barrier structure that protects the knee of the leg from impact injury. The knee guard structure 103 has a non-Euclidean disk structure. The knee guard structure 103 has a composite prism structure.

The shin guard structure 101 attaches to the knee guard structure 103 such that the shin guard structure 101 rotates relative to the knee guard structure 103. The shin guard structure 101 attaches to the knee guard structure 103 such that the shin guard structure 101 rotates over a limited arc relative to the knee guard structure 103. The thigh guard structure 102 attaches to the knee guard structure 103 such that the thigh guard structure 102 rotates relative to the knee guard structure 103. The thigh guard structure 102 attaches to the knee guard structure 103 such that the thigh guard structure 102 rotates over a limited arc relative to the knee guard structure 103.

The knee guard structure 103 comprises a knee pad 131, a knee plate 132, a plurality of knee straps 133, a knee spring mount 134, and at least one bolt 135.

The knee pad 131 is a disk shaped structure. The knee pad 131 has a non-Euclidean disk shape. The knee pad 131 is an elastic structure. The knee pad 131 is the structure of the knee guard structure 103 that is proximal to the knee of the leg. The knee pad 131 is geometrically similar to the knee of the leg. The knee pad 131 encloses the knee of the leg. The knee pad 131 is a cushion that forms a protective barrier between the knee plate 132 and the knee of the leg. The knee pad 131 absorbs impact energy received from the knee plate 132. The absorbed impact energy deforms the elastic structure of the knee pad 131.

The knee plate 132 is a disk shaped structure. The knee plate 132 has a non-Euclidean disk shape. The knee plate 132 is a rigid structure. The knee plate 132 is the structure of the knee guard structure 103 that is distal from the knee of the leg. The knee plate 132 is geometrically similar to the knee pad 131. The knee plate 132 encloses the knee pad 131. The knee plate 132 forms the exterior surface of the protective barrier formed by the knee guard structure 103 that receives impact energy from the environment. The knee plate 132 deflects a portion of the received impact energy away from the knee pad 131. The knee plate 132 transfers the balance portion of the received impact energy to the knee pad 131. The knee pad 131 mounts in the interior surface of the knee plate 132 to form the composite disk structure of the knee guard structure 103.

The plurality of knee straps 133 is a textile based structure. The plurality of knee straps 133 is formed from a collection of textile based straps. The plurality of knee straps 133 are used to bind the knee guard structure 103 to the knee of the leg.

The knee spring mount 134 is an anchor point. The knee spring mount 134 mounts to the exterior surface of the knee plate 132. The knee spring mount 134 forms an anchor point. The torsion spring structure 104 attaches to the knee guard structure 103 by anchoring to the knee spring mount 134.

The torsion spring structure 104 is a spring. The torsion spring structure 104 is a mechanical structure that converts rotational energy into mechanical potential energy. The torsion spring structure 104 releases the mechanical potential energy back into rotational energy. The torsion spring structure 104 attaches to the knee such that the rotation of the knee rotates the torsion spring structure 104. The rotation of the knee into a squatting position provides the rotational energy that rotates the torsion spring structure 104 into a deformed position. The rotation of the knee into a standing position releases the torsion spring structure 104 towards the relaxed shape such that the torsion spring structure 104 releases the stored mechanical potential energy in a manner that assists the rotation of the knee into the standing position.

The torsion spring structure 104 attaches to the shin spring mount 114 of the shin guard structure 101. The torsion spring structure 104 attaches to the thigh spring mount 124 of the thigh guard structure 102. The torsion spring structure 104 attaches to the knee spring mount 134 of the knee guard structure 103.

The torsion spring structure 104 comprises a shin torsion lever 141, a thigh torsion lever 142, and a torsion coil 143.

The torsion coil 143 is a mechanical structure. The torsion coil 143 is a torsion spring that anchors to the knee spring mount 134. The torsion coil 143 forms the energy storage device of the torsion spring structure 104. The shin torsion lever 141 attaches to the torsion coil 143. The thigh torsion lever 142 attaches to the torsion coil 143.

The shin torsion lever 141 is a first lever that attaches to the torsion coil 143. The thigh torsion lever 142 is a second lever that attaches to the torsion coil 143. The torsion spring structure 104 is designed such that the shin torsion lever 141 can move relative to the thigh torsion lever 142. The deformation energy stored within the torsion coil 143 changes as the relative position of the shin torsion lever 141 to the thigh torsion lever 142 changes.

The shin torsion lever 141 is an extension structure that bridges the reach between the torsion coil 143 and the shin spring mount 114. The thigh torsion lever 142 is an extension structure that bridges the reach between the torsion coil 143 and the thigh spring mount 124. The rotation of the shin guard structure 101 relative to the knee guard structure 103 provides the motive forces that change the position of the shin torsion lever 141 relative to the thigh torsion lever 142. The rotation of the thigh guard structure 102 relative to the knee guard structure 103 provides the motive forces that change the position of the thigh torsion lever 142 relative to the shin torsion lever 141.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anchor: As used in this disclosure, anchor means to hold an object firmly or securely.

Anchor Point: As used in this disclosure, an anchor point is a location to which a first object can be securely attached to a second object.

Anterior: As used in this disclosure, anterior is a term that is used to refer to the front side or direction of a structure. When comparing two objects, the anterior object is the object that is closer to the front of the structure.

Appendage: As used in this disclosure, appendage is a generic term used to describe one or more limbs of a patient. An appendage that primarily transfers the load of the patient to a supporting surface is referred to as a leg. An appendage without this primary purpose is referred to as an arm. The term limb is a synonym for appendage.

Arc: As used in this disclosure, an arc refers to a portion of a circumference or a curved perimeter. When applied to an angle or cant, the arc also refers to a measure of an angular span as measured from a circle at the vertex formed by the sides of the angle.

Barrier: As used in this disclosure, a barrier is a physical obstacle that forms a boundary between a first space and a second space. The barrier prevents the passage of an object between the first space and the second space.

Bind: As used in this disclosure, to bind is a verb that means to tie or secure a first object to a second object using a strap, cord or webbing. Bind can also mean to tie or secure a plurality of similar first objects together by wrapping a second object around the plurality of similar first objects.

Bridge: As used in this disclosure, a bridge refers to a load bearing structure that attaches a first object and to a second object such that a load bearing path is formed between the first object and the second object. The verb "to bridge" means to establish a connection (or remove a disconnection) between a first object and a second object.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Composite: As used in this disclosure, composite refers to a two-dimensional or three-dimensional structure that is formed from two or more distinctly identifiable layered sub-structures.

Composite Prism: As used in this disclosure, a composite prism refers to a structure that is formed from a plurality of structures selected from the group consisting of a prism structure, a pyramid structure, and a spherical structure. The plurality of selected structures may or may not be truncated or bifurcated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Cushion: As used in this disclosure a cushion is an elastomeric structure formed that is used to prevent injury or damage to a person or object.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Distal and Proximal: As used in this disclosure, the terms distal and proximal refers to a directional sense or location relative to the medial axis of the body. When comparing the location of a first object relative to a second object, when the minimum span of the distance between the first object and the medial axis is greater than the minimum span of the distance between the second object and the medial axis, the first object is said to be the distal object or the object distal from the medial axis. Alternately, when the minimum span of the distance between the first object and the medial axis is lesser than the minimum span of the distance between the second object and the medial axis, the first object is said to be the proximal object or the object proximal to the medial axis.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Elastic Nature: As used in this disclosure, an elastic nature refers to a flexible structure that returns to its relaxed shape after the flexible structure has been deformed.

Energy: As used in this disclosure, the energy is a term used in physics. Energy refers to the ability of a system to do work. Energy is a conserved property of a system. Energy is a quantifiable and is generally expressed in units of Joules.

Euclidean Surface: As used in this disclosure, a Euclidean surface refers to a two-dimensional plane that is formed without a curvature. By without a curvature is meant that the shortest distance between any two points on a Euclidean surface forms a line that remains on the Euclidean surface.

Extension Structure: As used in this disclosure, an extension structure is an inert physical structure that is used to extend or bridge the reach between any two objects.

Exterior: As used in this disclosure, the exterior is used as a relational term that implies that an object is not contained within the boundary of a structure or a space.

Flexible: As used in this disclosure, flexible refers to an object or material that will deform when a force is applied to it but that will not necessarily return to its original shape when the deforming force is removed.

Force: As used in this disclosure, a force refers to a net (or unopposed) measurable interaction that changes the direction of motion of an object, the velocity of motion of an object, the momentum of an object, or the stress within an object. The term work refers to a measure of the amount of energy that is transferred through the application of a force over a distance. The term power refers to a measure of the amount of energy that is transferred over a period of time.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. By the term essentially geometrically similar is meant that the primary shapes of two objects are geometrically similar except that there are functional items (such as fastening devices) associated with the primary shape may not maintain the ratio for geometric similarity. By the term roughly geometrically similar is meant that the form factors between the primary shape of the two objects can vary by a factor of up to 10% when the two objects are normalized to be roughly geometrically identical.

Guard: As used in this disclosure, a guard is an inert structure that attaches to or encloses a structure such that the guard forms a barrier intended to prevent objects from crossing a boundary.

Hinge: As used in this disclosure, a hinge is a device that permits the turning, rotating, or pivoting of a first object relative to a second object. A hinge designed to be fixed into a set position after rotation is called a locking hinge. A spring loaded hinge is a hinge formed as an elastic structure. The elastic structure of the spring loaded hinge is deformed under a rotating force such that the elastic structure returns the spring loaded hinge back to its relaxed shape after the rotating force is removed from the spring loaded hinge.

Impact: As used in this disclosure, an impact refers to an exchange of momentum between two objects over a duration. An impact often refers to a collision between two objects.

Inelastic Nature: As used in this disclosure, an inelastic nature refers to a flexible structure that maintains its new shape after the flexible structure has been deformed.

Inferior: As used in this disclosure, inferior refers to a directional sense or location of the body. Specifically, inferior refers to an object or a side of an object that is proximal to the feet or distal from the head of the body.

Interior: As used in this disclosure, the interior is used as a relational term that implies that an object is contained within the boundary of a structure or a space.

Joint: As used in this disclosure, a joint refers to the attachment of a first bone of a body to a second bone of the body such that the first bone is able to rotate relative to the second bone.

Lateral: As used in this disclosure, lateral refers to a directional sense or location of the body. Specifically, lateral refers to an object or a side of an object that is proximal to the side or that is distal from the medial axis of the body. The lateral direction movement is always perpendicular to the anterior posterior axis. Lateral movement is often called sideways movement.

Left and Right: As used in this disclosure, the terms left and right are directional references associated with an object. The object is further defined with an anterior surface and a posterior surface. The terms left and right are standardized naming conventions for the lateral directions of the object. The terms left and right use the human body for the initial definition of the orientation. Specifically, when a human body is viewed from posterior side towards the anterior side, the left side of the human body is the lateral side of the human body that contains the heart. The right side of the human body is the lateral side of the body that contains the bulk of the liver. The left and right sides of the human body remain unchanged by changes to the direction from which the human body is viewed. The left side of any object is the same side as the left side of the human body when the object is viewed is viewed from posterior side towards the anterior side. The right side of any object is the same side as the right side of the human body when the object is viewed is viewed from posterior side towards the anterior side. The left and right sides of the object remain unchanged by changes to the direction from which the object is viewed.

Limited Arc Rotation: As used in this disclosure, a limited arc rotation refers the rotation of a structure that: a) has a rotation that allows the reversal of the direction of rotation of the structure; and, b) has an maximum span of arc of rotation of less than 360 degrees.

Medial: As used in this disclosure, medial refers to a directional sense or location of the body. Specifically, medial refers to a first object or a side of a first object that is closer to the medial axis or more distal from the side of the body relative to a second object or side of a second object.

Medial Axis: As used in this disclosure, the medial axis is the center line of the body as the line is drawn from the head to the foot. When two objects are compared relative to the medial axis, the object closer to the medial axis is referred to as the medial object and the object distal from the medial axis is referred to as the lateral object.

Momentum: As used in this disclosure, momentum is a measured quantity associated with the mass of a moving object. The momentum of the object equals the mass of the object multiplied by the velocity of the object. The exchange of momentum between two objects is a conserved quantity meaning that the sum of the momentums of the two objects before an exchange of momentum equals the sum of the momentums of the two objects after the exchange.

Negative Space: As used in this disclosure, negative space is a method of defining an object through the use of open or empty space as the definition of the object itself, or, through the use of open or empty space to describe the boundaries of an object.

Non-Euclidean Disk: As used in this disclosure, a non-Euclidean structure is a disk-shaped structure wherein the congruent end (faces) of the disk structure lies on a non-Euclidean plane.

Non-Euclidean Plane: As used in this disclosure, a non-Euclidean plane (or non-Euclidean surface) is a geometric plane that is formed with a curvature such that: a) two parallel lines will intersect somewhere in the planar surface; or, b) the span of the perpendicular distance between two parallel lines will vary as a function of the position of the plane; or, c) the minimum distance between two points on the non-Euclidean plane as measured along the non-Euclidean plane is greater than the absolute minimum distance between the same two points. In many geometries, the statements (a) and (b) can be considered identical statements. A non-Euclidean plane is said to form a roughly Euclidean surface (or plane) when the span of the minimum distance between two points on the non-Euclidean plane as measured along the non-Euclidean plane is less than or equal to 1.1 times the absolute minimum distance between the same two points.

Non-Euclidean Structure: As used in this disclosure, a non-Euclidean structure is a structure wherein: a) the non-Euclidean structure is formed with a non-Euclidean plane; b) the non-Euclidean structure has an axis that lies on a non-Euclidean plane or is otherwise formed with a curvature; or, c) a combination of both (a) and (b) above.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction. In a one to one correspondence, the first element of the first set is said to be associated to the second element of the second set to which the first element corresponds.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Perimeter: As used in this disclosure, a perimeter is one or more curved or straight lines that bounds an enclosed area on a plane or surface. The perimeter of a circle is commonly referred to as a circumference.

Pivot: As used in this disclosure, a pivot is a rod or shaft around which an object rotates or swings.

Primary Shape: As used in this disclosure, the primary shape refers to a description of the rough overall geometric shape of an object that is assembled from multiple components or surfaces. The term essential primary shape is used to indicate the exclusion of functional items that are attached to the structure of the primary shape.

Primary Structure: As used in this disclosure, a primary structure refers to the component of an object that the other components attach to. The primary structure is also called the base structure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Protected Space: As used in this disclosure, a protected space is a negative space within which an object is stored. The protected space is enclosed by a barrier structure that: a) prevents damage to the object contained within the protected space; b) maintains conditions that are appropriate for the object; c) protects the object within the protected space from potential dangers that are outside of the protected space; or, d) maintains the privacy of the object within the protected space.

Posterior: As used in this disclosure, posterior is a term that is used to refer to the side of an object that is distal or in the opposite direction of the anterior side. When comparing two items, the posterior item is the item that is distal from the anterior of the object.

Proximal: As used in this disclosure, the term proximal is used to describe the relative location of two objects in relation to a specified reference point. The proximal object is the object that is closer to the specified reference point.

Relaxed Shape: As used in this disclosure, a structure is considered to be in its relaxed state when no shear, strain, or torsional forces are being applied to the structure.

Rigid Structure: As used in this disclosure, a rigid structure is a solid structure formed from an inelastic material that resists changes in shape. A rigid structure will permanently deform as it fails under a force. See bimodal flexible structure.

Rotation: As used in this disclosure, rotation refers to the cyclic movement of an object around a fixed point or fixed axis. The verb of rotation is to rotate.

Roughly: As used in this disclosure, roughly refers to a comparison between two objects. Roughly means that the difference between one or more parameters of the two compared objects are not significantly different.

Spring: As used in this disclosure, a spring is a device that is used to store mechanical energy. This mechanical energy will often be stored by: 1) deforming an elastomeric material that is used to make the device; 2) the application of a torque to a semi-rigid structure; or 3) a combination of the previous two items.

Strap: As used in this disclosure a strap is a strip of leather, cloth, or other flexible material, often with a buckle, that is used to fasten, secure, carry, or hold onto something.

Strip: As used in this disclosure, the term describes a long and narrow object of uniform thickness that appears thin relative to the length of the object. Strips are often rectangular in shape. Strips often have a disk shape.

Superior: As used in this disclosure, superior refers to a directional sense or location of the body. Specifically, superior refers to an object or a side of an object that is distal from the feet or proximal to the head of the body.

Reach: As used in this disclosure, reach refers to a span of distance between any two objects.

Torsion Spring: As used in this disclosure, a torsion spring is a mechanical device that stores mechanical energy through an opposing torque when the mechanical device is bent or twisted. The torsion spring will return to its original relaxed shape when the twisting force is removed.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A shin guard with a spring biased knee joint comprising
- a shin guard structure, a thigh guard structure, a knee guard structure, and a torsion spring structure;
- wherein the shin guard structure attaches to the knee guard structure;
- wherein the thigh guard structure attaches to the knee guard structure;
- wherein the torsion spring structure attaches to the shin guard structure, the thigh guard structure, and the knee guard structure;
- wherein the shin guard structure attaches to the knee guard structure such that the shin guard structure rotates relative to the knee guard structure;
- wherein the shin guard structure attaches to the knee guard structure such that the shin guard structure rotates over a limited arc relative to the knee guard structure;
- wherein the thigh guard structure attaches to the knee guard structure such that the thigh guard structure rotates relative to the knee guard structure;
- wherein the thigh guard structure attaches to the knee guard structure such that the thigh guard structure rotates over a limited arc relative to the knee guard structure.

2. The shin guard with a spring biased knee joint according to claim 1
- wherein the shin guard with a spring biased knee joint is a guard;
- wherein the shin guard with a spring biased knee joint is a mobility assistance device.

3. The shin guard with a spring biased knee joint according to claim 2
- wherein the shin guard structure is a protective structure;
- wherein the shin guard structure is a worn structure;
- wherein the shin guard structure forms a barrier structure;
- wherein the shin guard structure has a non-Euclidean disk structure;
- wherein the shin guard structure has a composite structure.

4. The shin guard with a spring biased knee joint according to claim 3
- wherein the thigh guard structure is a protective structure;
- wherein the thigh guard structure is a worn structure;

wherein the thigh guard structure forms a barrier structure;

wherein the thigh guard structure has a non-Euclidean disk structure;

wherein the thigh guard structure has a composite structure.

5. The shin guard with a spring biased knee joint according to claim 4 wherein the knee guard structure is a protective structure;

wherein the knee guard structure is a worn structure;

wherein the knee guard structure forms a barrier structure;

wherein the knee guard structure has a non-Euclidean disk structure;

wherein the knee guard structure has a composite structure.

6. The shin guard with a spring biased knee joint according to claim 5 wherein the torsion spring structure attaches to the knee guard structure by anchoring to a knee spring mount;

wherein the torsion spring structure is a spring;

wherein the torsion spring structure is a mechanical structure that converts rotational energy into mechanical potential energy;

wherein the torsion spring structure releases the mechanical potential energy back into rotational energy.

7. The shin guard with a spring biased knee joint according to claim 6 wherein the torsion spring structure attaches to a shin spring mount of the shin guard structure;

wherein the torsion spring structure attaches to a thigh spring mount of the thigh guard structure;

wherein the torsion spring structure attaches to the knee spring mount of the knee guard structure.

8. The shin guard with a spring biased knee joint according to claim 7 wherein the shin guard structure comprises a shin pad, a shin plate, a plurality of shin straps, and a shin spring mount;

wherein the shin pad is a disk shaped structure;

wherein the shin pad has a non-Euclidean disk shape;

wherein the shin pad is an elastic structure;

wherein the shin pad is a cushion that forms a protective barrier;

wherein the shin pad absorbs impact energy received from the shin plate;

wherein the absorbed impact energy deforms the elastic structure of the shin pad;

wherein the shin plate is a disk shaped structure;

wherein the shin plate has a non-Euclidean disk shape;

wherein the shin plate is a rigid structure;

wherein the shin plate is geometrically similar to the shin pad;

wherein the shin plate encloses the shin pad;

wherein the shin plate forms the exterior surface of the protective barrier formed by the shin guard structure that receives impact energy from the environment;

wherein the shin plate deflects a portion of the received impact energy away from the shin pad;

wherein the shin plate transfers the balance portion of the received impact energy to the shin pad;

wherein the shin pad mounts in the interior surface of the shin plate to form the composite structure of the shin guard structure;

wherein the plurality of shin straps is a textile based structure;

wherein the plurality of shin straps is formed from a collection of textile based straps;

wherein the plurality of shin straps are used to bind the shin guard structure;

wherein the shin spring mount is an anchor point;

wherein the shin spring mount mounts to the exterior surface of the shin plate;

wherein the shin spring mount forms an anchor point;

wherein the torsion spring structure attaches to the shin guard structure by anchoring to the shin spring mount.

9. The shin guard with a spring biased knee joint according to claim 8 wherein the thigh guard structure comprises a thigh pad, a thigh plate, a plurality of thigh straps, and a thigh spring mount;

wherein the thigh pad is a disk shaped structure;

wherein the thigh pad has a non-Euclidean disk shape;

wherein the thigh pad is an elastic structure;

wherein the thigh pad is a cushion that forms a protective barrier;

wherein the thigh pad absorbs impact energy received from the thigh plate;

wherein the absorbed impact energy deforms the elastic structure of the thigh pad;

wherein the thigh plate is a disk shaped structure;

wherein the thigh plate has a non-Euclidean disk shape;

wherein the thigh plate is a rigid structure;

wherein the thigh plate is geometrically similar to the thigh pad;

wherein the thigh plate encloses the thigh pad;

wherein the thigh plate forms the exterior surface of the protective barrier formed by the thigh guard structure that receives impact energy from the environment;

wherein the thigh plate deflects a portion of the received impact energy away from the thigh pad;

wherein the thigh plate transfers the balance portion of the received impact energy to the thigh pad;

wherein the thigh pad mounts in the interior surface of the thigh plate to form the composite structure of the thigh guard structure;

wherein the plurality of thigh straps is a textile based structure;

wherein the plurality of thigh straps is formed from a collection of textile based straps;

wherein the plurality of thigh straps are used to bind the thigh guard structure;

wherein the thigh spring mount is an anchor point;

wherein the thigh spring mount mounts to the exterior surface of the thigh plate;

wherein the thigh spring mount forms an anchor point;

wherein the torsion spring structure attaches to the thigh guard structure by anchoring to the thigh spring mount.

10. The shin guard with a spring biased knee joint according to claim 9 wherein the knee guard structure comprises a knee pad, a knee plate, a plurality of knee straps, and the knee spring mount;

wherein the knee pad is a disk shaped structure;

wherein the knee pad has a non-Euclidean disk shape;

wherein the knee pad is an elastic structure;

wherein the knee pad is a cushion that forms a protective barrier;

wherein the knee pad absorbs impact energy received from the knee plate;

wherein the absorbed impact energy deforms the elastic structure of the knee pad;

wherein the knee plate is a disk shaped structure;

wherein the knee plate has a non-Euclidean disk shape;

wherein the knee plate is a rigid structure;

wherein the knee plate is geometrically similar to the knee pad;

wherein the knee plate encloses the knee pad;

wherein the knee plate forms the exterior surface of the protective barrier formed by the knee guard structure that receives impact energy from the environment;

wherein the knee plate deflects a portion of the received impact energy away from the knee pad;

wherein the knee plate transfers the balance portion of the received impact energy to the knee pad;

wherein the knee pad mounts in the interior surface of the knee plate to form the composite structure of the knee guard structure;

wherein the plurality of knee straps is a textile based structure;

wherein the plurality of knee straps is formed from a collection of textile based straps;

wherein the plurality of knee straps are used to bind the knee guard structure;

wherein the knee spring mount is an anchor point;

wherein the knee spring mount mounts to the exterior surface of the knee plate;

wherein the knee spring mount forms an anchor point.

11. The shin guard with a spring biased knee joint according to claim 10 wherein the torsion spring structure comprises a shin torsion lever, a thigh torsion lever, and a torsion coil;

wherein the torsion coil is a mechanical structure;

wherein the torsion coil is a torsion spring that anchors to the knee spring mount;

wherein the torsion coil forms the energy storage device of the torsion spring structure;

wherein the shin torsion lever attaches to the torsion coil;

wherein the thigh torsion lever attaches to the torsion coil;

wherein the shin torsion lever is a first lever that attaches to the torsion coil;

wherein the thigh torsion lever is a second lever that attaches to the torsion coil;

wherein the torsion spring structure is designed such that the shin torsion lever can move relative to the thigh torsion lever;

wherein the deformation energy stored within the torsion coil changes as the relative position of the shin torsion lever to the thigh torsion lever changes;

wherein the shin torsion lever is an extension structure that bridges the reach between the torsion coil and the shin spring mount;

wherein the thigh torsion lever is an extension structure that bridges the reach between the torsion coil and the thigh spring mount;

wherein the rotation of the shin guard structure relative to the knee guard structure provides the motive forces that change the position of the shin torsion lever relative to the thigh torsion lever;

wherein the rotation of the thigh guard structure relative to the knee guard structure provides the motive forces that change the position of the thigh torsion lever relative to the shin torsion lever.

* * * * *